United States Patent [19]

Strehlow

[11] Patent Number: 4,506,984

[45] Date of Patent: Mar. 26, 1985

[54] PAN TYPE MIXING MACHINE

[75] Inventor: Robert W. Strehlow, New Berlin, Wis.

[73] Assignee: Mixer Systems, Inc., Milwaukee, Wis.

[21] Appl. No.: 502,490

[22] Filed: Jun. 9, 1983

[51] Int. Cl.[3] ..... B01F 7/18; B28C 5/16; B28C 7/02; B28C 7/14

[52] U.S. Cl. ..... 366/65; 366/67; 366/172; 366/309

[58] Field of Search ..... 366/30–41, 366/65–67, 64, 169, 177, 181–183, 167, 168, 172, 309, 285, 286, 325, 326, 347, 601

[56] References Cited

U.S. PATENT DOCUMENTS

| | | | |
|---|---|---|---|
| 3,214,145 | 10/1965 | Brown, Jr. | 366/172 X |
| 4,098,494 | 7/1978 | Howlett | 366/168 X |
| 4,165,185 | 8/1979 | Fejmert | 366/65 |
| 4,191,478 | 3/1980 | Zupancic et al. | 366/65 X |

*Primary Examiner*—Timothy F. Simone
*Attorney, Agent, or Firm*—George A. Evans, Sr.

[57] ABSTRACT

The pan type mixing machine has vertical concentric annular walls between which material to be mixed is confined while paddles hung from a central revolving spindle churn such material. The transmission is supported on a ledge extending inwardly from the inner wall of the mixing space. The transmission is driven by a motor arranged outside the outer wall on frame members extending under the mixer, the frame members protecting the drive between the motor and the transmission. A novel seal is provided between the rotating spindle and the inner wall of the mixing chamber along with multiple means for adjusting the mixing paddles and protecting the arms that support them. The cover extending over the mixer space provides means for introducing liquid and also serves to reinforce the walls of the mixer when the latter is being lifted or lowered by a sling. The cover is easily detachable from the mixer enabling it to be rotated to provide the most desirable position through which an opening may be cut to align such opening with the duct used for feeding material into the mixer.

4 Claims, 9 Drawing Figures

FIG.3
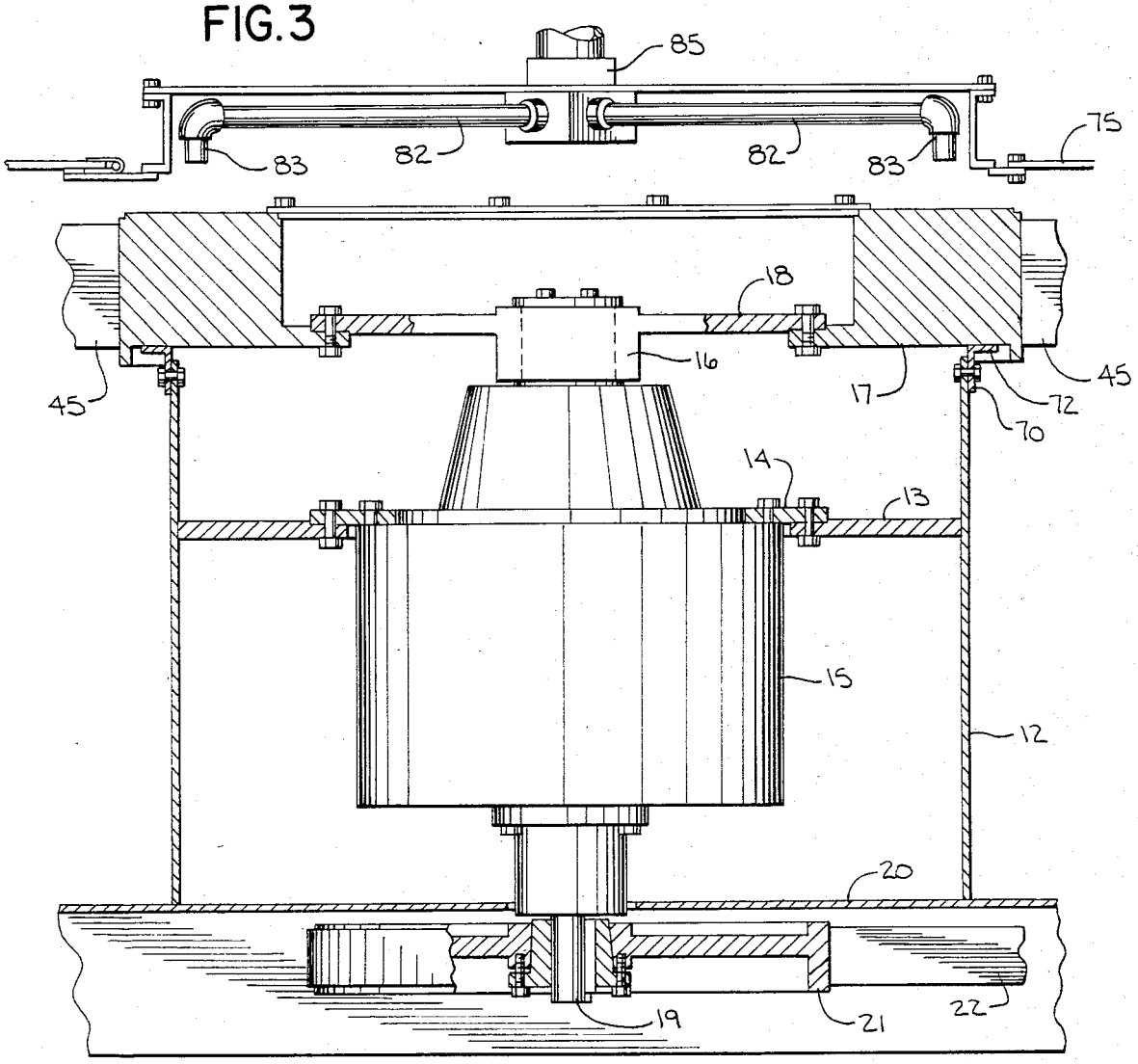
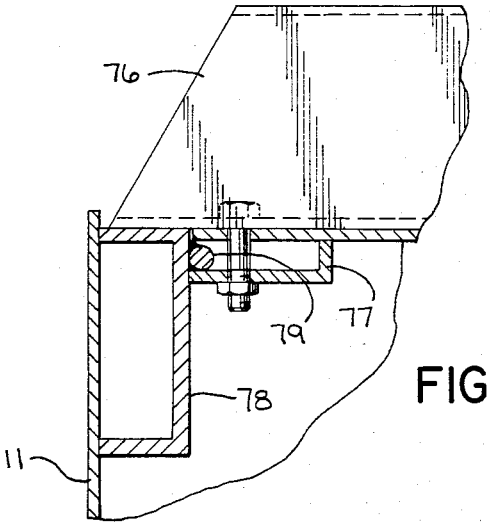
FIG.5
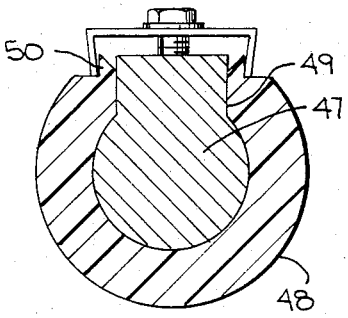
FIG.6

PAN TYPE MIXING MACHINE

BACKGROUND OF THE INVENTION

Pan type mixers are used extensively for producing thorough mixing of ingredients such as those used to make concrete, glass, and other mixed substances. The present invention relates to mixers having a circular pan that cooperates with an axial rotating spindle carrying mixing blades or paddles that agitate the material being mixed. The material is confined in an annular trough formed between concentric upstanding walls. The disposition of the rotating paddles causes a braiding action of the materials being mixed, so that there is little liklihood of any unmixed material remaining in the mixing space provided the machine is operated a requisite period of time.

The invention is being applied to mixers of the above class which may run all the way from ½ cubic yard to 4½ cubic yard batch capacity. Such large machines require a specially sturdy construction because of the heavy loads placed upon them. They are also subjected to extreme wear and because of their weight, must be well supported. Objections to machines previously used have included excessive mixing time, degradation of materials during mixing and inadequate strength and sturdiness to withstand the type of service frequently encountered. A further objection has been the over-all height, which increases the height of the charging apparatus used to load the mixer from a space above it.

The present invention substantially overcomes the above difficulties and results in improved performance, maintenance and life as well as more economical manufacture.

SUMMARY OF THE INVENTION

The transmission unit that reduces the speed from the driving motor is located in the well formed by the inner wall of the mixing chamber. This well is open at the bottom and at the top, enabling the transmission to be removed in either direction when service is required. Location of the transmission in this general position is shown in U.S. Pat. No. 4,165,185 issued Aug. 21, 1979, to Bernhard V. Fejmert, which has certain short comings which the present invention overcomes.

According to the present invention, a ledge is provided extending inwardly from the inner wall of the mixing chamber intermediate the top and bottom of the well. This ledge has a central opening and a mounting ring supported from the ledge is bolted to the transmission unit. The input shaft of the transmission extends below the mixing chamber and is driven by a belt trained over a sheave mounted on the output shaft of the driving motor. The motor itself is adjustably mounted on parallel frame members extending from side to side across the full width of the mixer, said frame members shielding the belt drive and being spaced apart sufficiently to enable the lowering of the transmission between them when removal is required.

Mounted on the output shaft of the transmission is a supporting hub from which the paddles are hung. An adjustable seal is provided between the hub and the top of the well, the hub being provided with an opening through which the transmission can be removed. Novel means are provided on the arms supporting the paddles permitting a wide range of adjustment.

The cover is also improved with the major portion of it disposed within the walls of the mixing chamber.

Reinforcing braces support the wall when the mixer is being raised or lowered by a sling the sections of which may bear against the wall tending to collapse it. Water is introduced through an elevated central space in the cover into the mixing space surrounding the central well.

DESCRIPTION OF THE SEVERAL VIEWS OF THE DRAWINGS

FIG. 3 is a side elevation showing an enlarged cross section of the central portion of the mixer;

FIG. 5 is a detailed sectional view showing the mounting of the cover on the outer wall of the mixer;

FIG. 6 is a cross section of one of the paddle supporting arms showing how a removable, wear resistant cover is fastened thereto;

DETAILED DESCRIPTION

Figure 1:
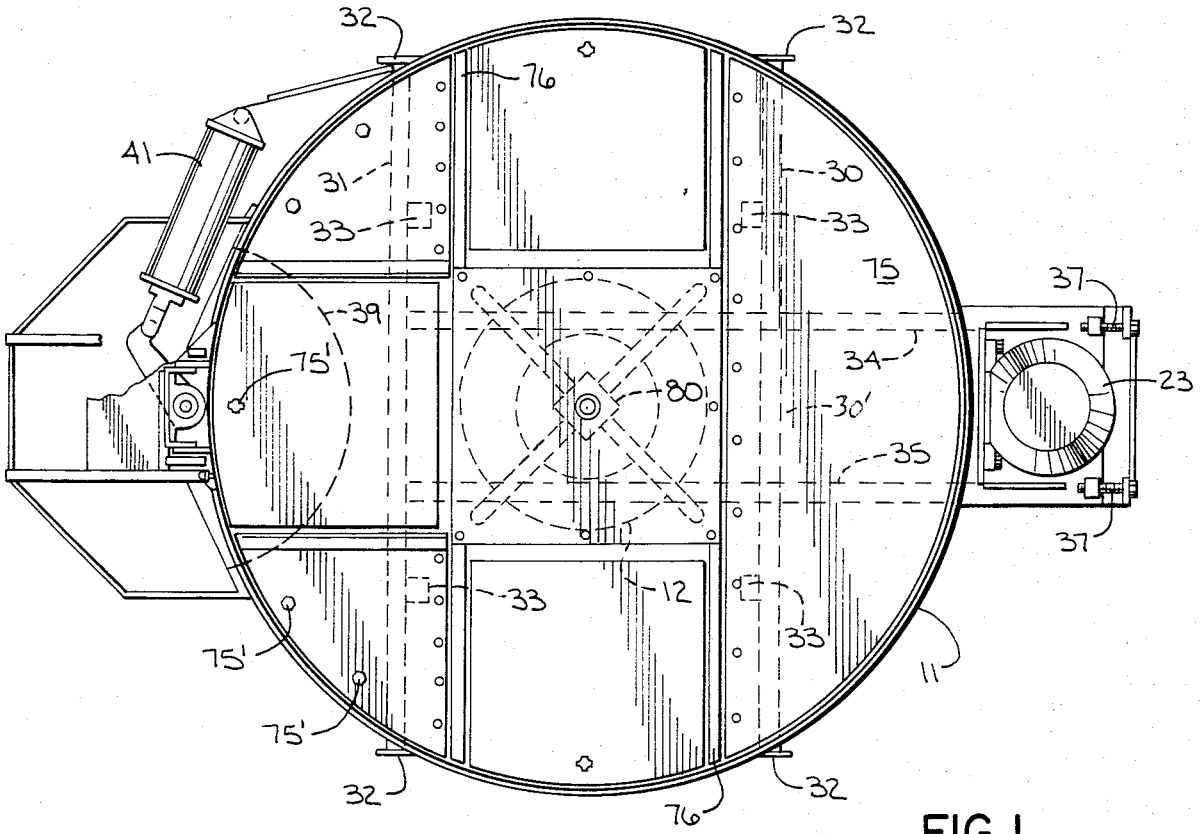
FIG. 1 is a plan view of the mixing machine.
Figure 2:
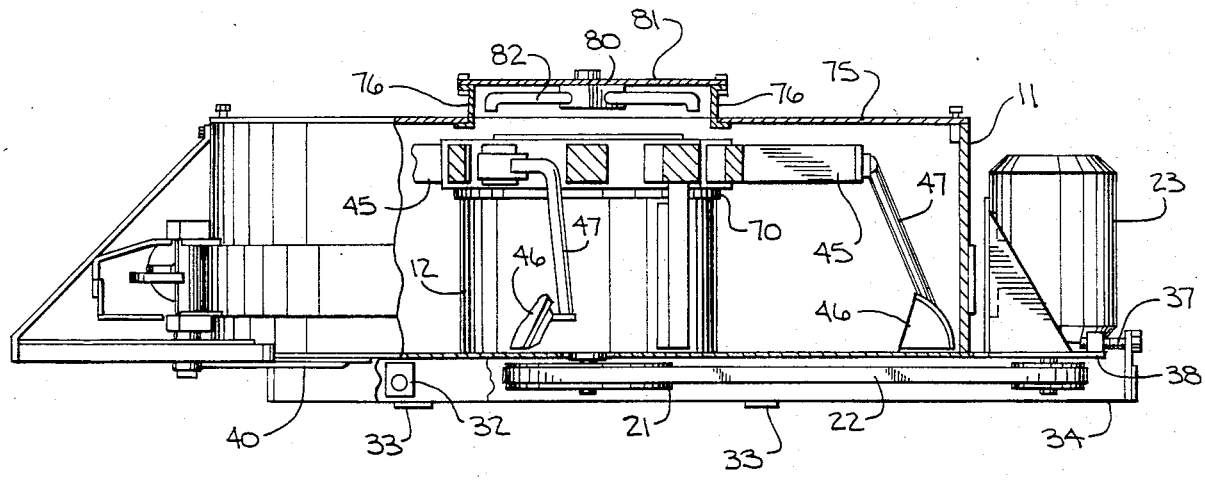
FIG. 2 is a side elevation of the mixer shown in FIG. 1 with parts broken away.

As shown in FIGS. 1 and 2, the mixer comprises the outer annular wall 11 and the inner annular wall 12. The space within the inner wall 12 will hereafter be referred to as the well. Within the well, slightly above the mid portion thereof is an inwardly extending ledge 13 (See FIG. 3) to which is bolted the supporting ring 14, which itself is bolted to the housing 15 of the speed reduction transmission. Actually, the mounting ring 14 is made in two pieces to facilitate assembly and dissambly.

The output shaft 16 of the transmission 15 extends upwardly above the top of the well and has secured thereto the rotating case assembly consisting of the support hub 17 and the drive hub 18, the latter being keyed to the shaft 16. The inner diameter of the support hub is larger than the transmission, as is the opening in the ledge 13 so that the transmission can be lifted therethrough in case repair or servicing is necessary.

The input shaft 19 of the transmission extends beneath the well and through the floor 20. The input shaft carries a sheave 21 driven by a motor 23 having an output shaft 24 and sheave 25 keyed thereto, over which the belt 22 is trained.

It should be pointed out the whole mixer is supported on a channel framework or weldmont arranged beneath it. This framework includes parallel spaced channel members 30 and 31, which extend across the entire base of the pan mixer. Each channel member 30 and 31 extends slightly beyond the outer wall 11. Apertured lifting tabs 32 are secured to the end sections of these channels, and four inwardly spaced mounting pads 33, which are on a radius slightly larger than that of the central well, are mounted on the underside of channels 30 and 31 providing supports for the entire machine. These pads minimize rocking motion which might otherwise occur if the channels rested directly on the floor or other support.

The channels 34 and 35, on which the motor 23 is mounted are arranged at right angles to the channels 30 and 31. They are space apart slightly more than the outer diameter of the transmission, whereby the latter can be lowered therethrough in case there is space beneath the mixer making it more convenient to lower the transmission rather than raise it if removal becomes necessary. As shown in FIG. 2, the channels 34 and 35 are wider than the belt 22 and thus protect the drive from possible damage. The outer ends of the channels 34 and 35 are connected by a cross member 36 which accomodates bolts 37, movement of which moves the framework 38 on which the motor rests. This enables the belt to be tensioned to the desired extent after which other bolts (not shown) clamp the framework supporting the motor in the desired position on the channels 34 and 35.

Channel 30 does not extend between channels 34 and 35, but a bar 30' arranged beneath the belt 22 connects channels 34 and 35 in this area.

The mixed material is discharged from the mixer through a door 39 in the bottom of the mixer at a space opposite the motor 23. A gate 40 is swung across the opening to open and close the same, movement of the gate being by the cylinder 41. The gate mechanism has been used for some time and forms no part of this invention.

It is also customary to line the inner sides of the outer wall with replaceable wear resistant material and also the floor of the mixing compartment, especially if abrasive material is being mixed.

Figure 4:
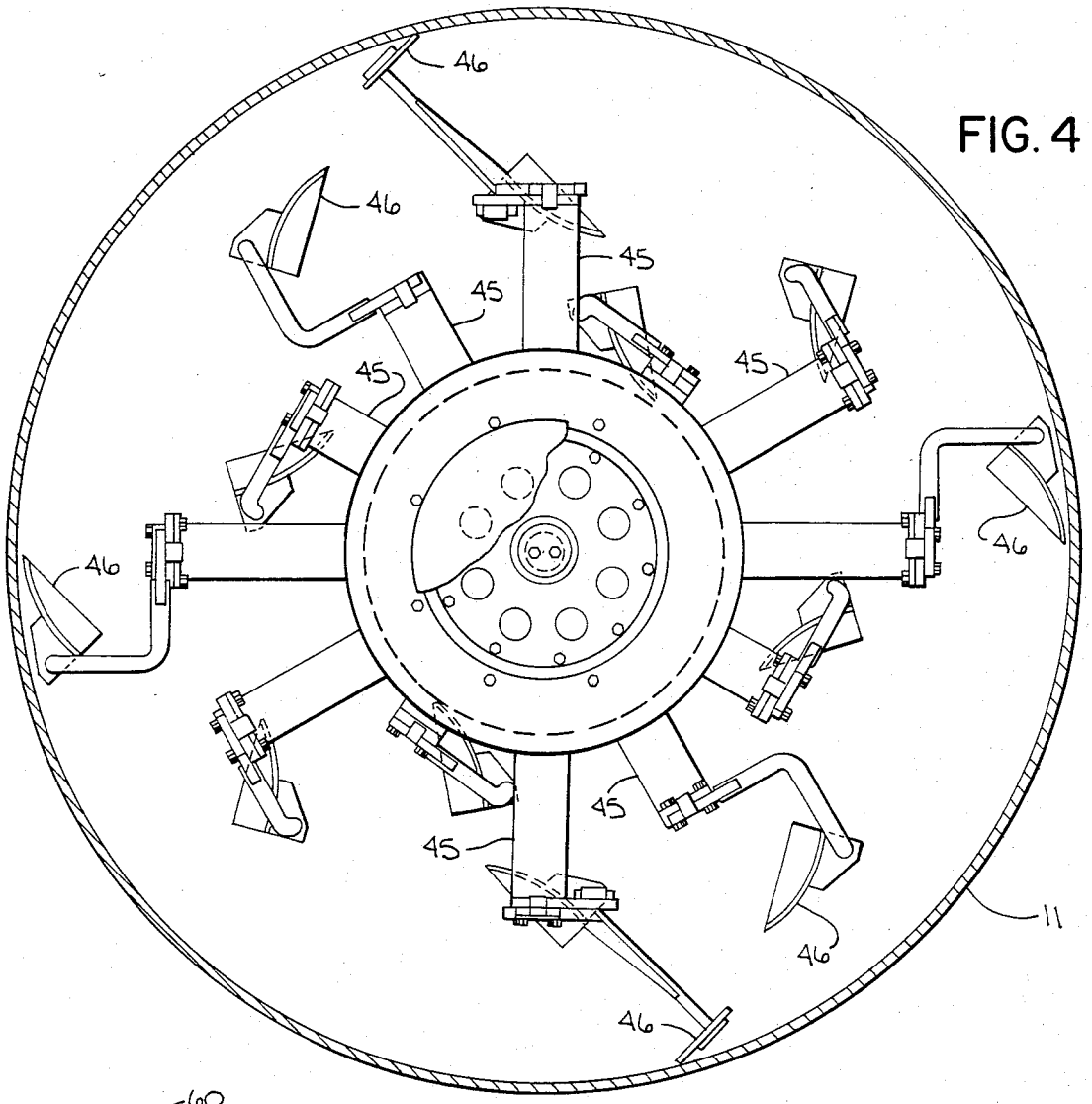
FIG. 4 is a plan view of the mixing compartment with the cover removed.

Referring to FIG. 4, there are a number of hollow trunnions 45 extending radially outward from the support hub 17 and each supports an arm 47 which carries a paddle 46 for mixing material confined in the mixing space between the walls 11 and 12. Some blades work the material inward from the outer walls, some blades move it outward from adjacent the inner wall and intermediate blades may alternately cause inward or outward movement. The bottoms of the paddle blades are quite closely adjacent the floor of the mixing compartment and their action produces effective mixing in a minimum period of time.

Connecting paddles 46 to trunnions 45 are solid arms 47 which may be of special cross sectional shape as shown in FIG. 6. These arms are subject to considerable abrasion as they are rotated through the material being mixed and accordingly an expandable plastic wear-resistant cover (not shown in FIG. 4, but detailed in FIG. 6) is provided, which is spread apart and snapped over the support arm 47. The arm 47 has a flat portion 49 and the inside shape of the cover conforms to the outside shape of the arm when assembled. The ends of the open section of the cover are provided with a flange 50 which is engaged by the clamp 51, arranged on the back side of the arm as it moves through the material being mixed. Several covers may be mounted on each arm enabling removal and replacement of one or both, depending on wear.

Figure 7:
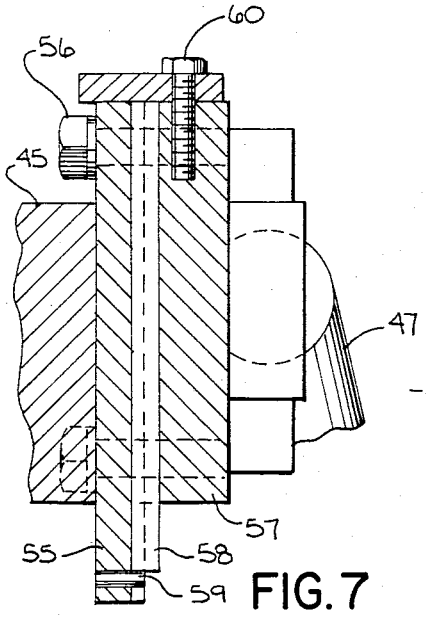
FIG. 7 shows how the upper ends of the paddle arms are adjustably mounted on the trunnions extending from the supporting hub.

Provision is made for adjustably mounting the arm 47 on the trunnion 45 as shown in FIG. 7. Mounted on the trunnion 45 is a plate 55 which has vertically slotted holes through which the bolts 56 extend. The plate 57 which is secured to the arm 47 has aligned threaded holes for the bolts 56 in engage. Between these plates is a vertical key 58 which aligns the plates 55 and 57 and rests on the roll pin 59 extending from the lower end of plate 55. The position of plate 57 relative to plate 55 may be adjusted by turning the bolt 60 which is threaded into the plate 57. This adjustment determines the clearance between the bottom of the paddle and the floor of the mixing compartment. When properly adjusted, the bolts 56 are tightened so that the bolt 60 is relieved of the load of holding the arm 47.

Figure 8:
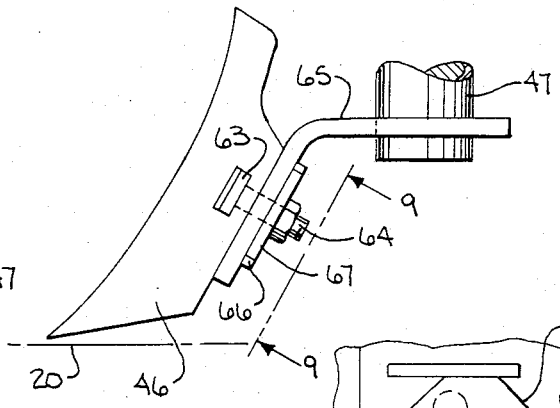
FIG. 8 is a side view of the adjustable mounting of the paddles.
Figure 9:
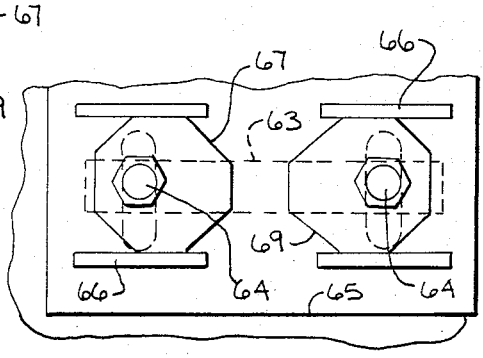
FIG. 9 is an end view taken on the plane 9—9 of FIG. 8.

For mounting the paddles 46 on the arms 47 (See FIGS. 8 and 9), a slot is provided in the back of the paddle and a bar 63 is locked against movement within the slot. Bar 63 has two spaced studs 64 extending therefrom which extend through the slotted holes in a mounting foot weldmont 65 secured to the lower end of the arm 47. On either side of the slotted holes are bars 65 which serve as guides for the octagonal washers 67. The hole in washers 67 through which the bolts 64 extend are eccentric with respect to the washers, so that by turning the washers the position of the paddle with respect to the mounting foot 65 may be adjusted to vary the clearance of the paddle from the floor 20 of the mixing compartment. The nuts 68 can then be tightened to hold the paddle in the correct position. By adjusting one washer with respect to the other, the paddle can be tilted, as will be apparent from FIG. 9.

To prevent material in the mixing space from entering the well formed by the wall 12, a seal is provided by the two semi-circular seal angles 70 which are connected by bolts 71 to the upper end of the wall 12. The angles 70 have outwardly extending flanges 72 which lie underneath and parallel to the underside of the hub 17 to form a running seal as the hub is rotated. The apertures in the upper portion of the wall 12 through which the bolts 71 extend are slotted in a vertical direction to permit seals 70 to be adjusted to conform to the surfaces to which they lie adjacent.

The cover generally designated 75 is provided with spaced stiffening channels 76 which extend from one side of the cover to the other. As shown in FIG. 5, these channels and other portions of the cover 75 are held by bolts 75' and hold-down clips 77, which abut a reinforcing ring 78 secured to the inside of the upper end of the outer wall 11. Movement of the clip 77 vertically of the wall is prevented by the ring 79 welded to the inner side of the stiffening ring 78. By removing the bolts 75' and the hold down clips 77, the cover can be rotated so that the most suitable portion of the cover can be aligned with a feed duct.

This construction enables the cover to reinforce the outer wall of the mixer when the channels 76 are arranged paralled to the channels 31 on the underside of the mixer. The chain sections of a lifting sling hooked to the holes in the tabs 32 at the ends of the channels 30 and 31 will bear against the reinforced portion of outer wall 11 when the sling is attached to a single central overhead location on a crane arranged over the mixer to raise or lower it. Once the mixer has been located in the desired position for subsequent operations, the cover can be turned as described since such reinforcement is no longer necessary.

Solid materials can be fed into the mixer through openings located in the cover 75, such opening being directly above a portion of the mixing chamber. If desired the portion of the cover where the opening is made can be provided with a hinged cover, or the feed duct can be suitable sealed to minimize dust problems.

For the introduction of water, or any other liquid being mixed with the dry materials, a liquid fitting 80 is located in the center of the cover 75. The fitting 80 is secured to a plate 81 extending between the channels 76 and the portion under the plate 81 has four radial pipes 82 leading to nozzles 83 for discharging the liquid at spaced points into the mixing compartment. Various types of nozzles may be employed to distribute the liquid evenly over the different sections of the mixer.

In operation, the mixing paddles should be set in rotation before the ingredients are charged into the mixing space. The water or other liquid is fed simultaneously with dry materials. For a 4½ cubic yard mixer the rpm of the drive hub 18 should be of the order of 18 rpm which develops a peripheral speed of approximately 600 feet per minute. After a suitable mixing period, the mixed batch is discharged through the outlet 39 in the floor of the mixer.

I claim:

1. In a horizontal, pan type mixing machine having vertical, spaced concentric annular walls defining a mixing chamber therebetween and rotating paddles for stirring the material disposed in said chamber, the inner annular wall describing a central cylindrical well which is open at the bottom and at the top, a horizontal ledge extending inwardly from said wall intermediate of the top and the bottom of the well, said ledge having a central opening, a speed transmission unit having an outer diameter smaller than the opening in said ledge, said transmission having an output shaft extending upwardly through said opening, means connecting said paddles with said output shaft, and a ring bolted to the ledge and supporting said transmission, whereby when the ring is disengaged from the ledge and the transmission, the transmission may be removed either upwardly or downwardly with respect to the well to enable servicing of the transmission in either position.

2. Apparatus according to claim 1 including a disengageable, rotating case connected to said output shaft extending outwardly over the upper end of said well and on which said mixing paddles are mounted, and a sealing ring surrounding the upper end of said well, said ring having an outwardly extending flange engaging the underside of said case to form a running seal therewith.

3. Apparatus according to claim 2 in where the ring is adjustably mounted for vertical movement with respect to the end of said well to vary the clearance between the ring and the rotating case.

4. In a pan type mixing machine having vertical, spaced concentric annular walls defining a mixing chamber therebetween and paddles for stirring the material to be mixed in the space between said walls, a cover fitting within the outer of said walls having an opening for charging material into the mixer, said outer annular walls having a stiffening ring arranged on the inner upper perimeter thereof, hold-down means straddling said ring to prevent upward and downward movement of said cover and removable means for fastening said cover to said hold-down means, and parallel spaced reinforcing members extending from side to side of said cover to reinforce the portion of the annular wall into which the cover extends, the arrangement being such that the cover may be detached from the hold down means and rotated to a position where the reinforcing members serve to resist collapse of the annular wall under pressure from an external force such as a set of hoisting chains.

* * * * *